US005682578A

United States Patent [19]

Shehata et al.

[11] Patent Number: 5,682,578

[45] Date of Patent: Oct. 28, 1997

[54] PASSIVE AIR BLOW OUT SEAL THROUGH RECIRCULATING CHAMBER

[75] Inventors: Ahmed-Mohsen T. Shehata, Penfield; Thomas C. Keyes, Fairport; Thomas J. Behe, Webster; Dan F. Lockwood, Ontario; Michael J. Palencar, Webster; Ronald A. Fraser, Rochester, all of N.Y.

[73] Assignee: Xerox Corporation, Stamford, Conn.

[21] Appl. No.: 595,458

[22] Filed: Feb. 5, 1996

[51] Int. Cl.[6] ..... G03G 15/08; G03G 21/00

[52] U.S. Cl. ..... 399/92; 399/98; 399/355; 399/358

[58] Field of Search ..... 399/92, 98, 102, 399/103, 353, 354, 355, 358, 149

[56] References Cited

U.S. PATENT DOCUMENTS

| | | | |
|---|---|---|---|
| 4,168,901 | 9/1979 | Ito et al. | 399/103 |
| 4,361,396 | 11/1982 | Uchida | 399/92 |
| 4,583,112 | 4/1986 | Morano et al. | 399/103 |
| 4,800,411 | 1/1989 | Tanaka et al. | 399/103 |
| 4,809,035 | 2/1989 | Allen, Jr. | 399/253 |
| 4,963,930 | 10/1990 | Yoshimaru et al. | 399/103 |
| 5,047,807 | 9/1991 | Kalyandurg | 399/264 |
| 5,243,388 | 9/1993 | Berns et al. | 399/90 |

*Primary Examiner*—Arthur T. Grimley
*Assistant Examiner*—Sophia S. Chen
*Attorney, Agent, or Firm*—John S. Wagley

[57] ABSTRACT

A channel for recirculating a stream of air located adjacent a stream of marking particles exiting substantially tangentially from a marking particle transport member within a developer unit is provided. The stream of marking particles defines an inner boundary thereof extending tangentially from a first position adjacent to the transport member and defines an outer boundary thereof spaced from the transport member and the inner boundary. The channel includes a first member positioned outside the stream of marking particles. At least a portion of the first member is positioned substantially adjacent the outer boundary of the stream of marking particles and is spaced from the transport member. The channel also includes a second member connected to the first member and a third member connected to the second member. The second member is positioned adjacent the transport member and is spaced from the stream of marking particles. Substantially all the stream of air being directed by the first member is sequentially directed by the second member and the third member.

30 Claims, 14 Drawing Sheets

FIG. 13

| TEST TYPE | PRESS., PASCALS | | |
|---|---|---|---|
| | TAP 1 | TAP 2 | TAP 6 |
| Baselane | 0.1495 | 0.1246 | 0.1246 |
| Recirculation Chamber | 0.0498 | 0.0249 | 0.0249 |

PASSIVE AIR BLOW OUT SEAL THROUGH RECIRCULATING CHAMBER

The present invention relates to a developer and/or cleaner apparatus for electrophotographic printing. More specifically, the invention relates to providing a conduit for recirculating air within a developer and/or cleaner unit.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by exposing it to a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material typically in the form of toner effectively adheres electrostatically to the imaged areas on the charge retentive surface.

Referring now to FIGS. 2 and 3, a prior art developer unit 1 is shown. The developer unit 1 is used to convey developer material to the latent image. The developer unit 1 typically includes a developer housing 3 which defines a developer housing chamber 5 within the developer housing 3. Developer material 7 is moved axially within the chamber 5. A marking particle transport member 9 typically conveys the developer material 7 from the chamber 5 toward donor roll 8. The donor roll is a roll that extracts the toner off the developer material and is always coated with a thin layer of toner only. Typically, the marking particle transport member 9 is in the form of a roll.

The photoreceptor on which the image is formed must translate at a high speed adjacent the donor roll. To assure that the entire latent image is developed, the donor roll transports sufficient toner to fill all the portions of the latent image and typically includes an amount of toner in excess of that required to develop the latent image. The developer material includes carrier particles and toner. The developer material on the marking transport member 9 loses most of its toner as it contacts the donor roll. The material is then launched off the transport roll into chamber 5 of developer unit 1 toward back wall 11 of the developer housing 3 (see FIG. 2).

Referring now to FIG. 3, the launched marking particles together with entrained air rebound from the back wall 11 of the developer housing 3 and move outwardly to the outer edges 13 and 15 of the developer housing. The marking particles and air then escape from the developer housing causing contamination to occur within the interior of the copy machine. This flow of air and marking particles creates a pressure within the chamber 5 greater than ambient pressure making the sealing at the outer edges 13 and 15 of the developer housing 3 extremely difficult. The air and toner exhausted from the developer unit may contaminate the rest of the copy machine.

The containment of developer material within a developer unit utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference. In a scavengeless development system, toner is detached from the donor roll by applying AC electric field to self-spaced electrode structures, commonly in the form of wires positioned in the nip between a donor roll and photoreceptor in the case of hybrid scavengeless development or by applying the AC electrical field directly to the donor roll in the case of hybrid jumping development. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level", "recharge, expose and develop", "highlight"; or "image on image" color xerography.

Since hybrid scavengeless development relies on a continuous, steady toner powder cloud at the nip between the latent image and the donor roller, the speeds at which the rollers operate are significantly higher and accordingly the potential for emissions is also much higher.

In addition to the problems with the emission of toner from a development housing in high volume printing and copying machines, similar problems with toner emissions occur in cleaning housings.

Referring now to FIGS. 4 and 5, a prior art cleaning unit 1 a is shown. The cleaning unit 1 a is used to remove toner 7*a* and contaminants from photoreceptor 8*a*. The cleaning unit 1 a typically includes a cleaning housing 3*a* which defines a cleaning housing chamber 5*a* within the cleaning housing 3*a*. The removed toner 7*a* is collected within the chamber 5*a*. A brush 9*a* typically contacts the photoreceptor 8*a* and loosens up the remaining toner 7*a* and contaminants from the photoreceptor 8*a*. A cleaning blade 2*a* then scrapes off the toner 7*a*. The waste toner 7*a* and contaminants from photoreceptor 8*a* are advanced by the blade 2*a*, the brush 9*a* and gravity to a waste bottle 4*a* within the chamber 5*a* of housing 3*a*.

The photoreceptor on which the image is formed must translate at a high speed. To assure that the photoreceptor is properly cleaned, the brush 9*a* must rotate at sufficient speed to loosen the toner 7*a* and contaminants from the photoreceptor. A portion of the toner 7*a* and contaminants on the photoreceptor are then flickered off the brush 9*a* into chamber 5 of cleaning unit 1 (see FIG. 4).

Referring now to FIG. 5, the launched toner 7*a* together with entrained air within the cleaning housing 3*a* move outwardly to the outer edges 13*a* and 15*a* of the cleaning housing 3*a*. The toner 7*a* and air then escape from the cleaning housing 3*a* causing contamination to occur within the interior of the copy machine. This flow of air and toner creates a pressure within the chamber 5*a* greater than ambient pressure making the sealing at the outer edges 13*a* and 15*a* of the cleaning housing 3*a* extremely difficult. The air and toner exhausted from the cleaning unit may contaminate the rest of the copy machine.

The following disclosures may be relevant to various aspects of the present invention:

U.S. Pat. No. 4,168,901, Patentee: Ito et al., Issue Date: Sep. 25, 1979

U.S. Pat. No. 4,361,396, Patentee: Uchida, Issue Date: Nov. 30, 1982

U.S. Pat. No. 4,583,112, Patentee: Morano et al., Issue Date: Apr. 15, 1986

U.S. Pat. No. 4,800,411, Patentee: Tanaka et al., Issue Date: Jan. 24, 1989

U.S. Pat. No. 4,809,035, Patentee: Allen, Jr., Issue Date: Feb. 28, 1989

U.S. Pat. No. 4,963,930, Patentee: Yoshimaru et al., Issue Date: Oct. 16, 1990

U.S. Pat. No. 5,047,807, Patentee: Kalyandurg, Issue Date: Sep. 10, 1991

U.S. Pat. No. 5,243,388, Patentee: Berns et al., Issue Date: Sep. 7, 1993

The relevant portions of the foregoing disclosures may be briefly summarized as follows:

U.S. Pat. No. 4,168,901 discloses a developer device for preventing scattering of developer in an electrophotographic copying machine. The device is applicable to a developing device or a cleaning device in opposed relationship with the surface of a photosensitive drum. The device includes a developer scatter preventing member in the form of a multiple lip stay which closely conforms to the photosensitive drum.

U.S. Pat. No. 4,361,396 discloses a apparatus for collecting scattering magnetic toner. The apparatus includes an air flow path, a toner collecting chamber at one end of the flow path, a suction device for generating a flow of air to the collecting chamber and magnets in the collecting chamber.

U.S. Pat. No. 4,583,112 discloses a vent for venting the interior of a developer housing. A toner hopper is located above the developer housing. An exhaust port is located in the upper portion of the developer housing between the housing and the hopper. A filter is located in the port. A wall is located between the housing chamber and the port and the exhaust is diverted between the wall and the housing.

U.S. Pat. No. 4,800,411 discloses a magnetic brush developer including a doctor blade for controlling the amount of developer on the magnetic roll. A toner fiber limiting blade is located spaced from the roll downstream of the doctor blade. An air flow passage is located in the limiting blade and permits air flow from downstream of the limiting blade to upstream of the limiting blade to equalize pressures therebetween.

U.S. Pat. No. 4,809,035 discloses a single component development apparatus including an unwanted non-magnetic particle chamber extending along the width of the toner unit below the toner hopper outlet. The non-magnetic particles pass by the magnetic roll unattracted thereto and are drawn by blower to the unwanted non-magnetic particle chamber.

U.S. Pat. No. 4,963,930 discloses a developing apparatus using dry toner. The apparatus includes a developer housing having a vent therein with a filter covering the vent. The housing is under positive pressure with the developer housing closely spaced from the photoconductive drum so that incoming air is at high velocity to avoid leakage of developer.

U.S. Pat. No. 5,047,807 discloses an internal scavenging device including a single, stiff, electrically conductive, non-magnetic plate which has an opening therein for the photoconductive drum. The plate is electrically charged to attract toner.

U.S. Pat. No. 5,243,388 discloses an apparatus for cleaning a developer unit including a cover placed over the developer unit. The cover has an air inlet and an air outlet. A vacuum source is connected to the air outlet to create an air flow within the developer unit for cleaning.

According to the present invention, there is provided a channel for recirculating a stream of air located adjacent a stream of marking particles exiting substantially tangentially from a marking particle transport member. The stream of marking particles defines an inner boundary thereof extending tangentially from a first position adjacent to the transport member and defines an outer boundary thereof spaced from the transport member and the inner boundary. The channel includes a first member positioned outside the stream of marking particles. At least a portion of the first member is positioned substantially adjacent the outer boundary of the stream of marking particles and is spaced from the transport member. The channel also includes a second member connected to the first member and a third member connected to the second member. The second member is positioned adjacent the transport member and is spaced from the stream of marking particles. Substantially all the stream of air being directed by the first member is sequentially directed by the second member and the third member.

According to the present invention, there is also provided a developer unit for developing with marking particles a latent image recorded on an image receiving member to form a developed image. The developer unit includes a housing for containing a supply of at least marking particles and a transport member mounted in the housing for transporting the marking particles toward the image receiving member. The developer unit also includes a channel for recirculating a stream of air located adjacent a stream of marking particles exiting substantially tangentially from a marking particle transport member. The stream of marking particles defines an inner boundary thereof extending tangentially from a first position adjacent to the transport member and defining an outer boundary thereof spaced from the transport member and the inner boundary. The channel includes a first member positioned outside the stream of marking particles. At least a portion of the first member is positioned substantially adjacent the outer boundary of the stream of marking particles and spaced from the transport member. The channel includes a second member connected to the first member and a third member connected to the second member. The second member is positioned adjacent the transport member and spaced from the stream of marking particles. Substantially all the stream of air directed by the first member is sequentially directed by the second member and the third member.

There is further provided an electrophotographic printing machine of the type having a developer unit adapted to develop with marking particles an electrostatic latent image recorded on a photoconductive member. The developer unit includes a housing for containing a supply of at least marking particles and a transport member mounted in the housing for transporting the marking particles toward the image receiving member. The developer unit also includes a channel for recirculating a stream of air located adjacent a stream of marking particles exiting substantially tangentially from a marking particle transport member. The stream of marking particles defines an inner boundary thereof extending tangentially from a first position adjacent to the transport member and defining an outer boundary thereof spaced from the transport member and the inner boundary. The channel includes a first member positioned outside the stream of marking particles. At least a portion of the first member is positioned substantially adjacent the outer boundary of the stream of marking particles and spaced from the transport member. The channel includes a second member connected to the first member and a third member connected to the second member. The second member is positioned adjacent the transport member and spaced from the stream of marking particles. Substantially all the stream of air directed by the first member is sequentially directed by the second member and the third member.

There is further provided a cleaning unit for cleaning excess marking particles from an image receiving member. The unit includes a housing for containing a supply of at least excess marking particles and a cleaning member mounted in the housing for cleaning the marking particles from the image receiving member. The unit further includes a channel for recirculating a stream of air located adjacent a stream of marking particles exiting substantially tangentially from the cleaning member. The stream of marking particles defines an inner boundary thereof extending tangentially from a first position adjacent to the transport member and defines an outer boundary thereof spaced from the transport member and the inner boundary. The channel includes a first member positioned outside the stream of marking particles. At least a portion of the first member is positioned substantially adjacent the outer boundary of the stream of marking particles and spaced from the transport member The channel also includes a second member connected to the first member and a third member connected to the second member. The second member is positioned adjacent the transport member and spaced from the stream of marking particles. Substantially all the stream of air being directed by the first member is sequentially directed by the second member and the third member.

IN THE DRAWINGS

Figure 6:
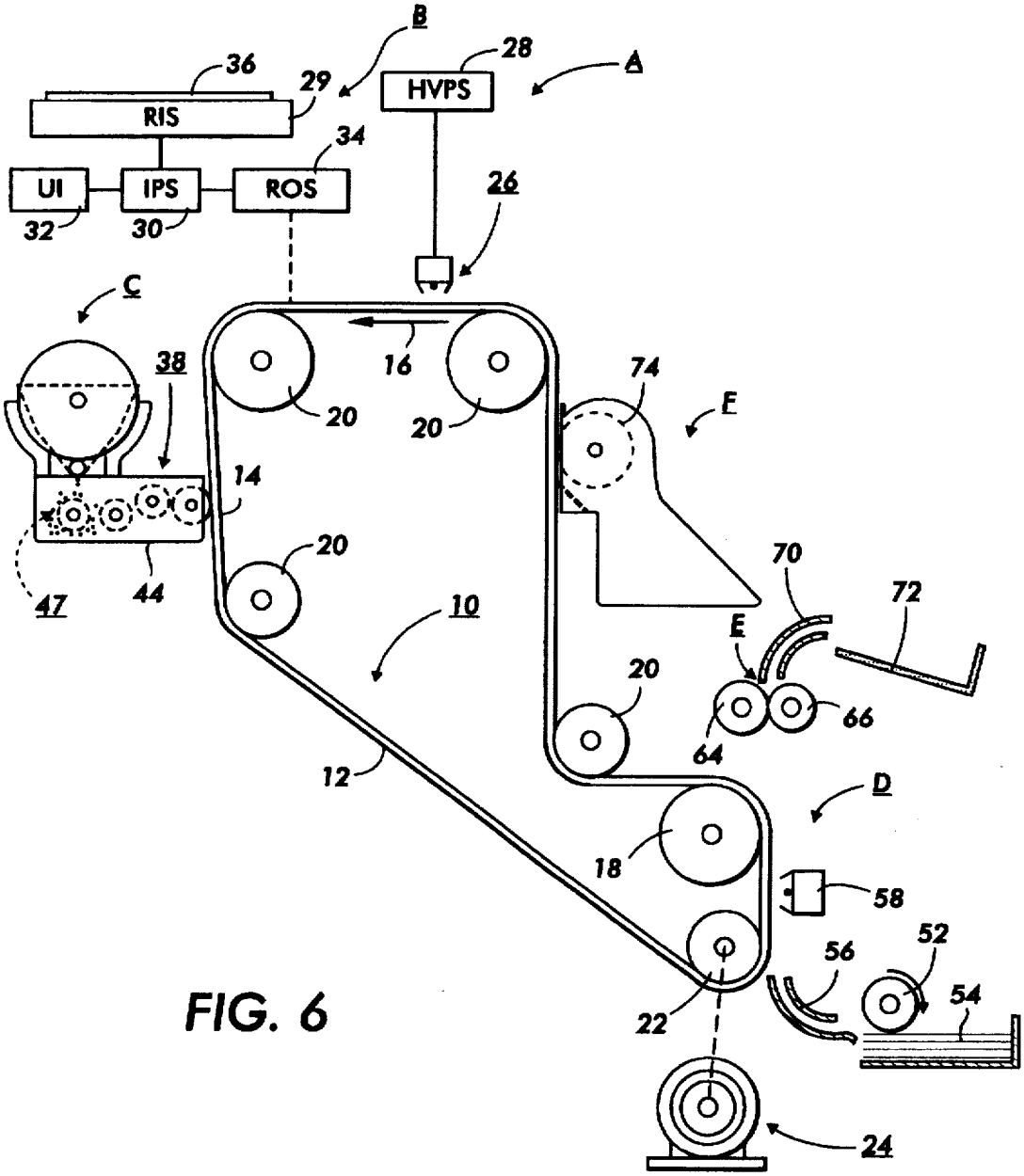
FIG. 6 is a schematic view of an illustrative electrophotographic printing machine incorporating the recirculation conduit of the development apparatus of the present invention therein.
Figure 9:
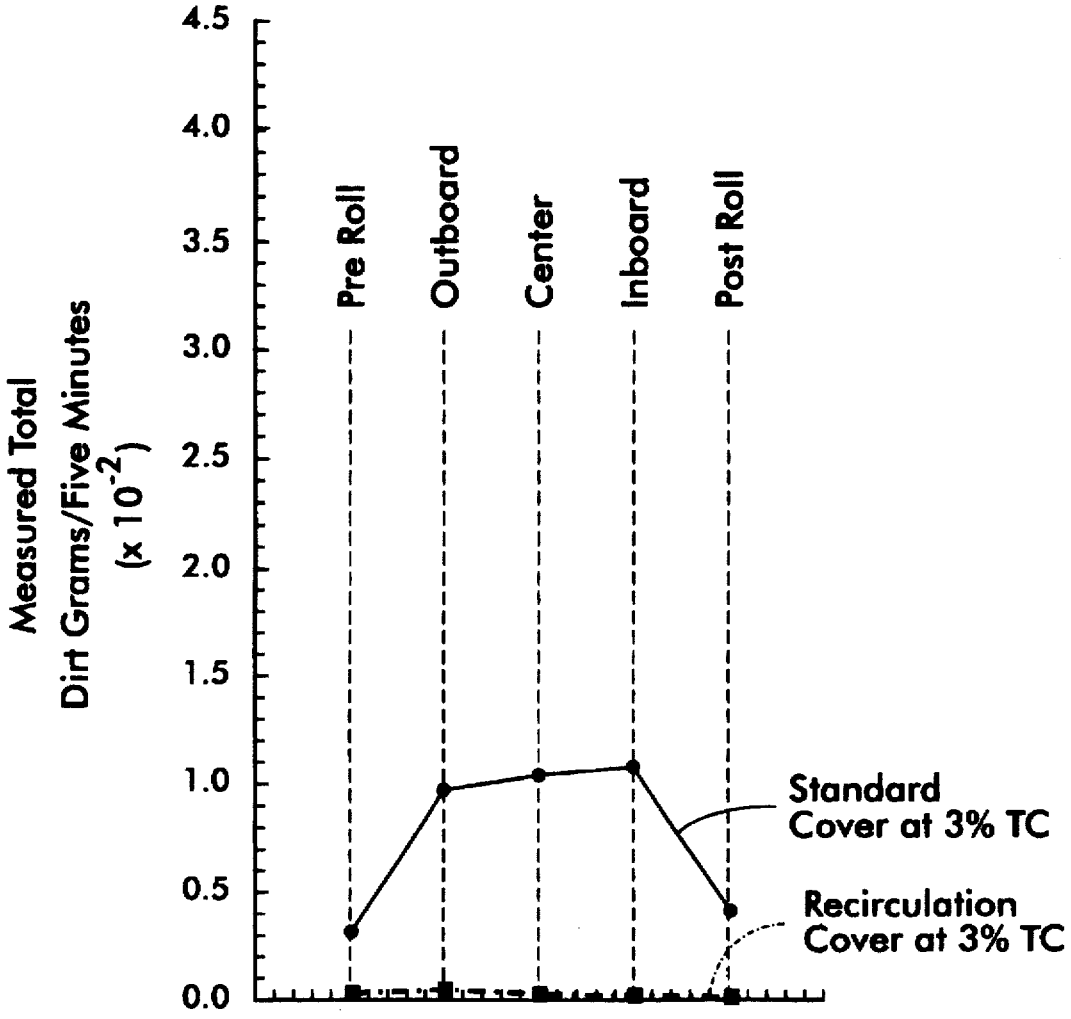
Figure 10:
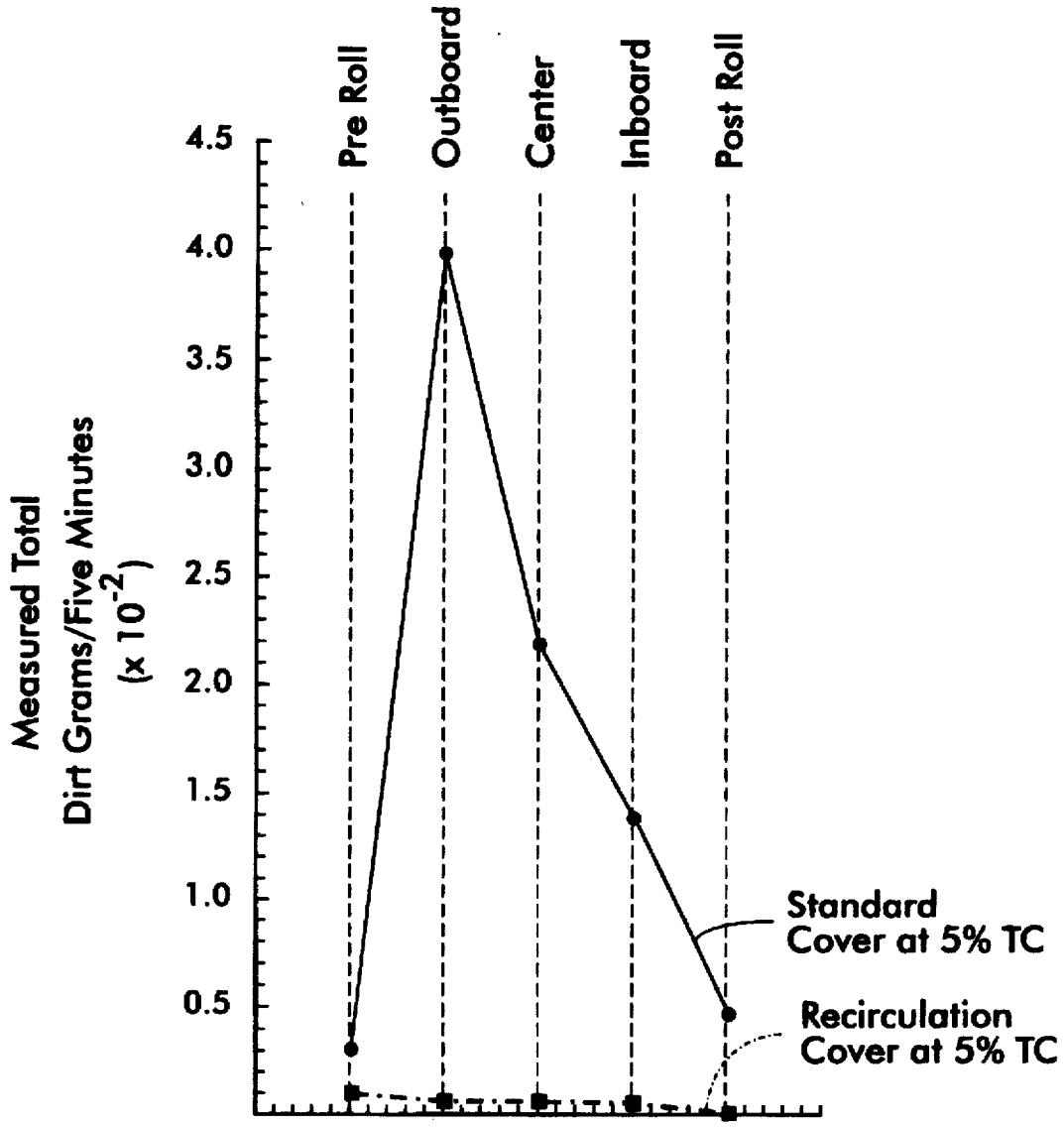
Figure 11:
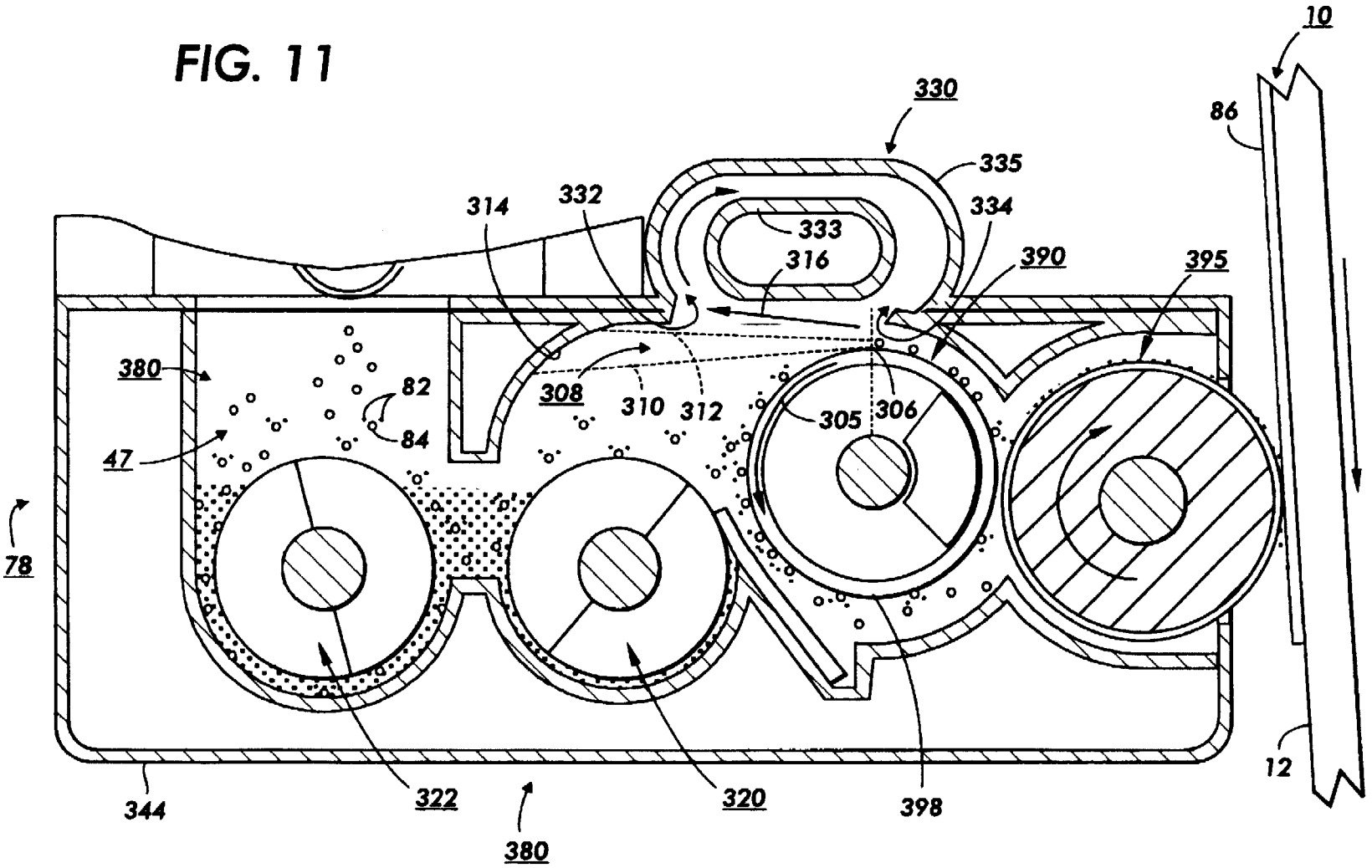
Figure 11A:
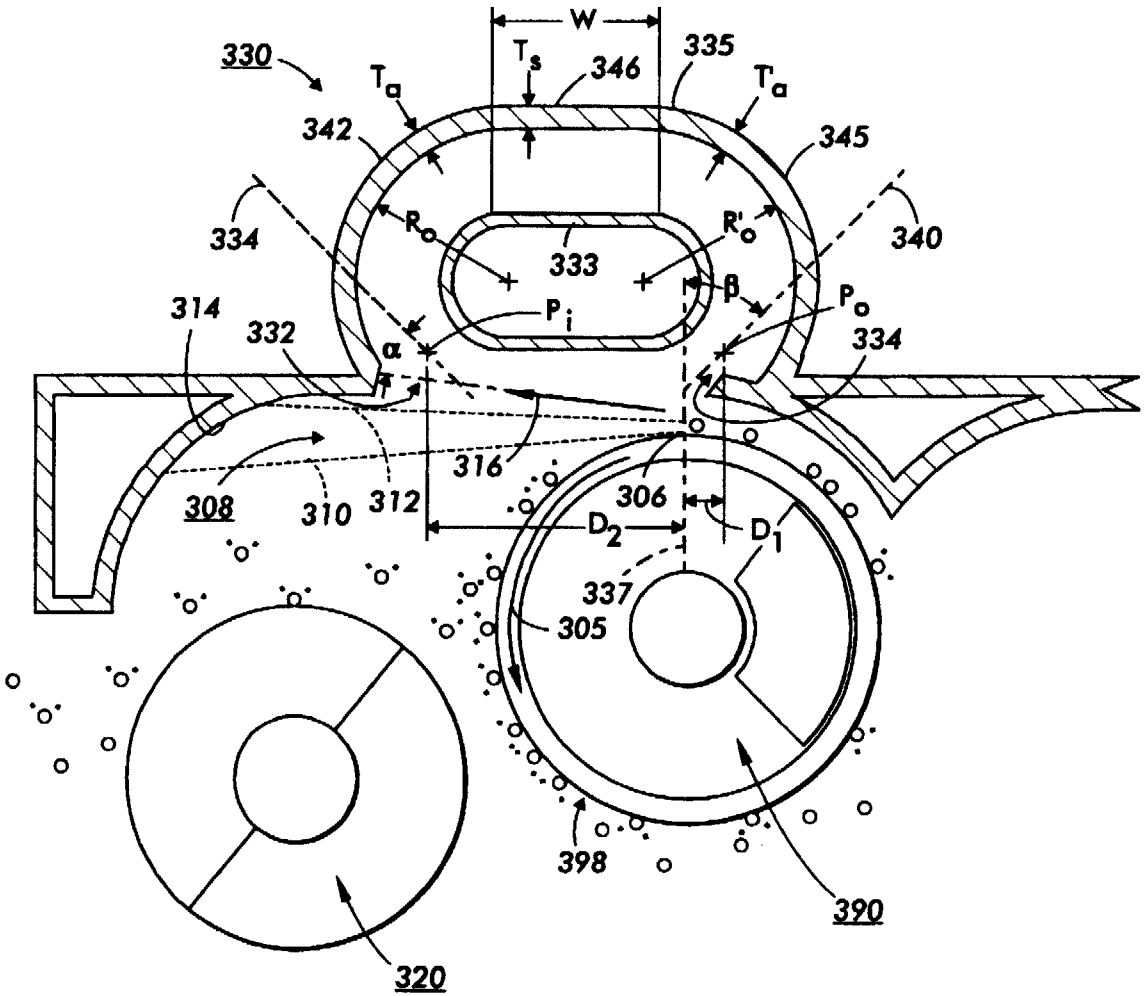
Figure 12:
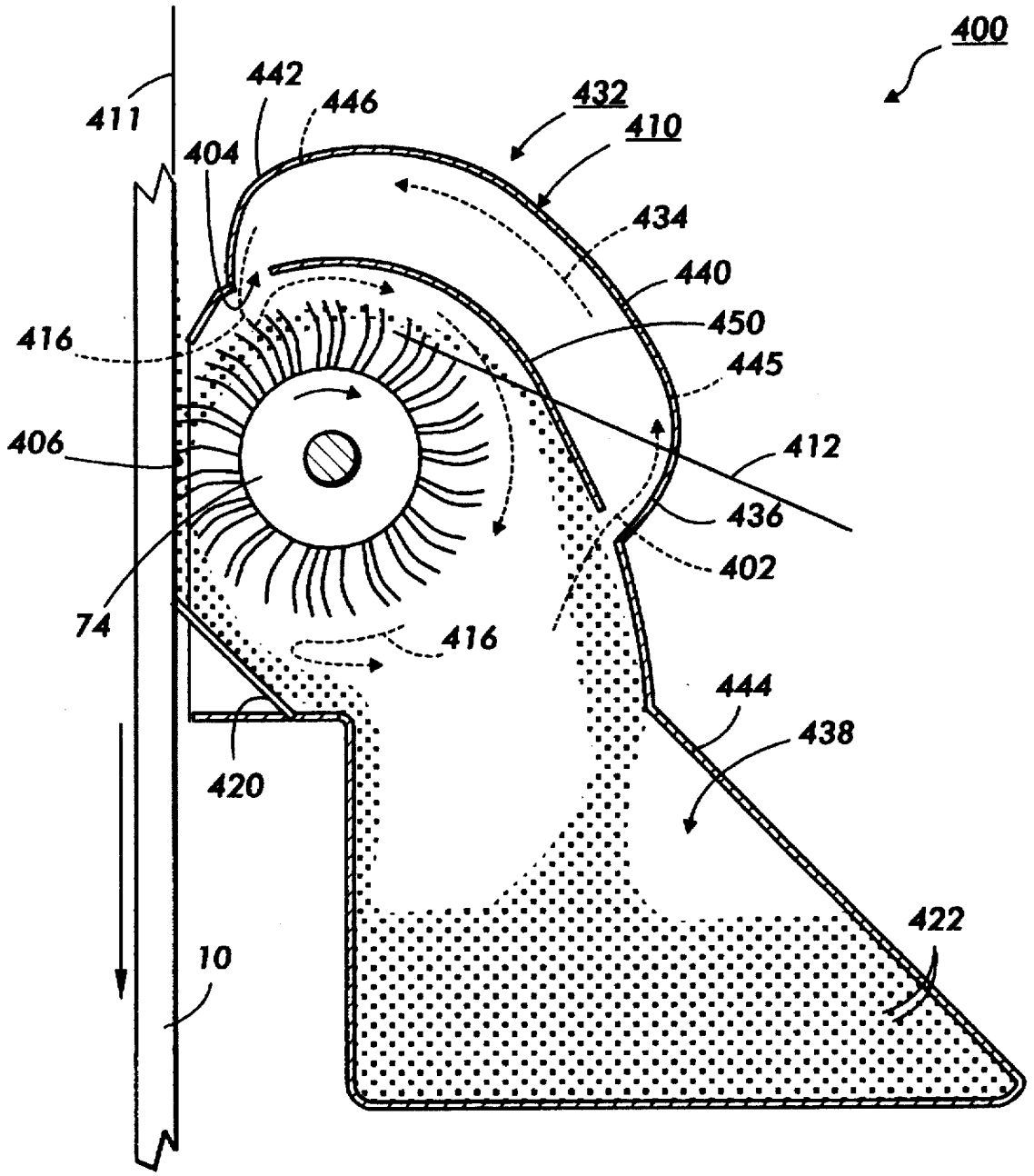

FIG. 9 is a graph of measured total dirt at 3% toner concentration at various locations outside the developer housing for the prior art housing and developer housing including the recirculation conduit of the present invention; and FIG. 10 is a graph of measured total dirt at 5% toner concentration at various locations outside the developer housing for the prior art housing and developer housing including the recirculation conduit of the present invention, FIG. 11 is a partial sectional view of an alternate embodiment of a development housing including a conduit for recirculating air and developer material within the development housing according to the present invention;

FIG. 11A is a partial sectional view of a portion of the development housing of FIG. 11;

FIG. 12 is a partial sectional view of a cleaning housing including a conduit for recirculating air and developer material within the cleaning housing according to the present invention of the developer unit of the copy machine of FIG. 6;

FIG. 13 is a table of location versus Pressure above Ambient for the prior art housing and the recirculation conduit of the cleaning apparatus of the present invention;

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 6 printing machine will be shown hereinafter schematically and their operation described briefly with reference thereto.

Referring now to FIG. 6, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to generator 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to the raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 6. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 6, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
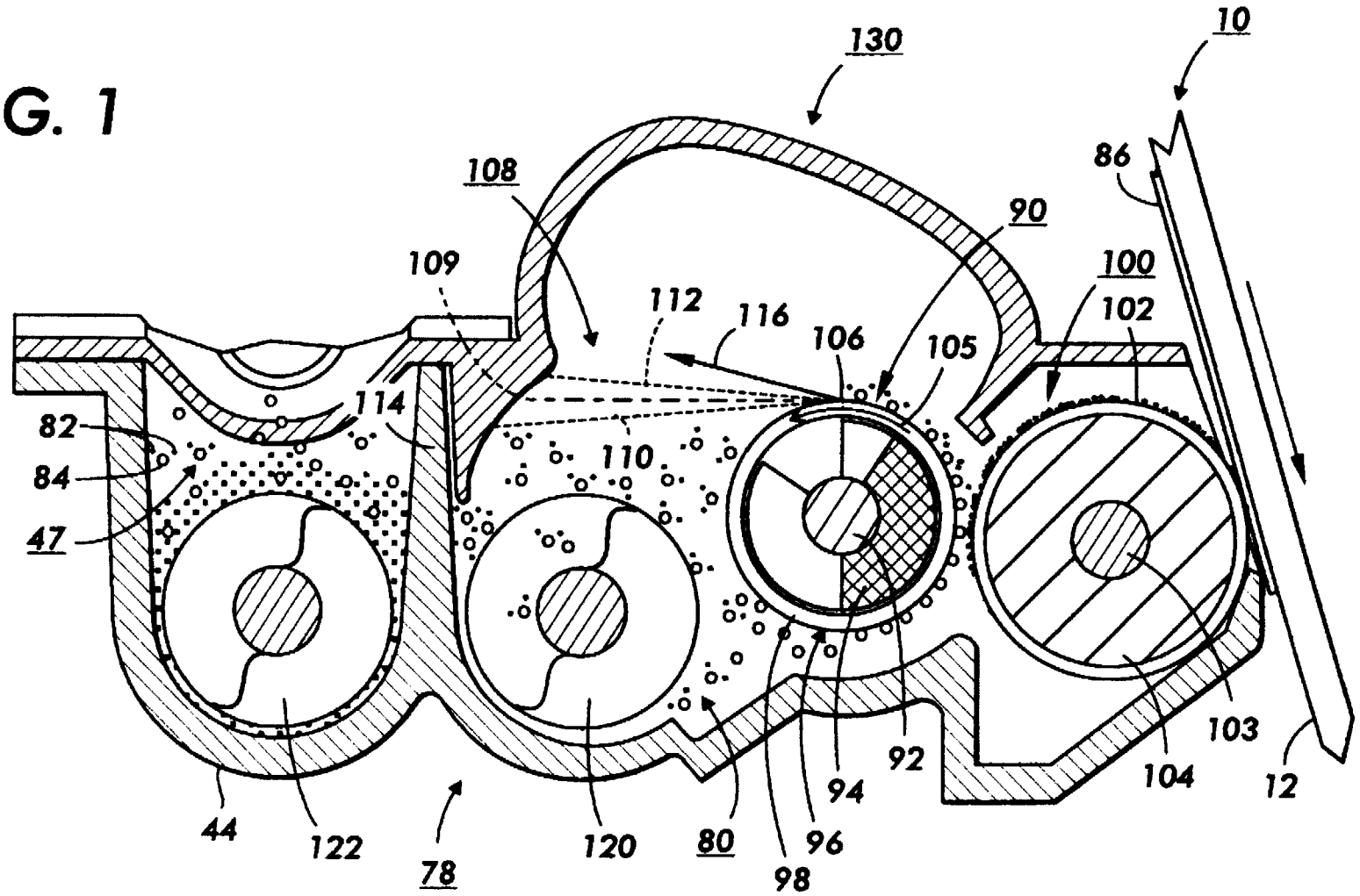
FIG. 1 is a partial sectional view of a development housing including a conduit for recirculating air and developer material within the development housing according to the present invention of the developer unit of the copy machine of FIG. 6.

The developer system 38 of the present invention as shown in FIG. 6 is shown in greater detail in FIG. 1. The development system includes developer unit 78. The developer unit 78 includes the developer housing 44 which defines a chamber 80 therein. Developer material 47 is located within the chamber 80 of the developer housing 44. The developer material 47 may consist essentially of marking particles 82 preferably in the form of toner particles. Preferably, however, the developer material 47 includes in addition to the toner particles 82, carrier granules 84 to which the toner particles 82 are triboelectrically attracted.

The use of carrier granules 84 improves the admixing and charging of the toner particles 82. The developer material 47 is advanced toward latent image 86 on the photoconductive surface 12 of the photoconductive belt 10 by marking particle transport member 90. The marking particle transport member 90 may take on any suitable form such as a belt or auger, but preferably is in the form of a roll.

When the developer material 47 includes carrier granules 84 as well as the toner particles 82, the transport member 90 is preferably in the form of a magnetic roll. The magnetic roll 90 may have any suitable configuration but preferably includes a stationary core 92 including a permanent magnet 94 positioned opposed to the sump of the developer housing 44. The stationary core 92 is surrounded by a rotating sleeve 96. The sleeve 96 is made of a non-magnetic material, for example, aluminum. The permanent magnet 94 attracts carrier granules 84 which forms chain of carrier granules 84 with attached toner particles 82 to the surface of the sleeve 96. The rotating sleeve 96 advances the particles 82.

These chains of developer material 47 including carrier granules 84 attracted thereto, as well as toner particles 82 triboelectrically attracted to the carrier granules 84 form chains of developer material 47 on a periphery 98 of the sleeve 96 of the magnetic roll 90. When using magnetic brush development (not shown), the chains of developer material brush against the latent image with the toner particles being attracted to the latent image.

It should be appreciated that, as shown in FIG. 1, a developer housing 44 containing two component developer material 47, including carrier granules 84 and toner particles 82, may be used with single component development. In such as system, a donor roll 100 is used to remove the toner particles 82 from the carrier granules 84. The toner particles 82 are then transferred to the latent image 86 by the donor roll 100. It should be appreciated that the donor roll 100 may likewise be in another form, for example, a donor belt.

The donor roll 100 is positioned between the magnetic roll 90 and the photoconductive member 10. Chains of the developer material 47 brush against the donor roll. The donor roll 100 is electrically charged with a charge of opposite polarity to that of the toner particles. The toner particles 82 are thereby attracted to periphery 102 of the donor roll 100. As the donor roll 100 rotates, the toner particles 82 are advanced to the latent image 86.

When using hybrid jumping development (HJD) the photoconductive belt is biased electrically with respect to the donor roll 100 such that the toner particles are electrically attracted from the donor roll and jump to the latent image, thereby developing it.

When using hybrid scavengeless development (HSD) electrodes (not shown) either located on the periphery of the donor roll or in the space between the donor roll and the photoconductive belt are electrically charged causing the toner particles to be attracted to the position between the donor roll and the photoconductive belt.

The donor roll 100 may be made from a core 103 of an electrically conductive suitable, durable material, such as a plastic, including an electrically conductive material dispersed therein or may be made of an electrically conductive metal. A semi-conductive layer 104 is applied over the core 103 to provide a proper resistive capacitive circuit through the semiconductive layer 104.

In order that the magnetic roll 90 provides sufficient toner particles 82 to the donor roll 100, where the copy machine produces a high volume of copies, for example, 60 copies per minute or more, the magnetic roll 90 must rotate at high velocity. For example, for a copy machine producing in excess of 60 cpm, a magnetic roll 90 with a diameter of one inch may need to travel in excess of 764 rpm or 40 inches per second added to the periphery 98 of the magnetic roll 90. When the magnetic roll 90 rotates in the direction of arrow 105, the excess toner particles 82, which are not transferred to the donor roll 100, are propelled tangentially from a first position 106 on the periphery 98 of the magnetic roll 90. The first position 106 represents a position on the magnetic roll 90 which is slightly away from the permanent magnet 94. This position is where the centrifugal force on the toner by the rapidly rotating magnetic roll 90 exceeds the magnetic force of the magnet 94. The stream of toner particles 82 exiting tangentially from the first position 106 of the magnetic roll 90 forms an inner stream 108 of marking particles. The inner stream 108 diverges as it moves away from the magnetic roll 90. The particles within the diverging inner stream 108 have a distribution that is centered about centerline 109. The particular form of the distribution varies with the shape of the developer housing and the speed of the transport roll 90. The form of the distribution may be normal with most of the particles located near centerline 109. Most of the particles are located between an inner boundary 110 and an outer boundary 112.

The inner stream 108 is bounded internally by the inner boundary 110. The inner stream 108 is further defined by the outer boundary 112 spaced from the inner boundary 110 and extending tangentially from a position slightly spaced from the periphery 98 of the magnetic roll 90. The inner stream 108 extends outwardly between the inner boundary 110 and outer boundary 112 and is further bounded by wall 114 between the outer boundary 112 and inner boundary 110. The inner stream 108 of marking particles which impinge upon wall 114 fall by gravity into the sump of the developer housing 44. Positioned slightly external to the outer boundary 112 of the marking particles is a outer stream 116 including air with marking particles 82 entrained within the outer stream 116.

The wall 114 separates first auger 120 from second auger 122. The marking particles 82 from the inner stream 108 of marking particles falls into the sump of the developer housing 44. The particles 82 are drawn by first auger 120 to one end of auger 120 at which a passageway permits the toner particles 82 to pass through wall 114 into the second auger 122. The second auger 122 translates the toner particles 82 in the opposite direction to a second opening at the opposite end of the developer housing. The circulating path of toner particles through the first auger 120 and the second auger 122 promotes mixing of the toner particles 82 with the carrier granules 84 and promotes the charging of the toner particles 82.

Figure 1A:
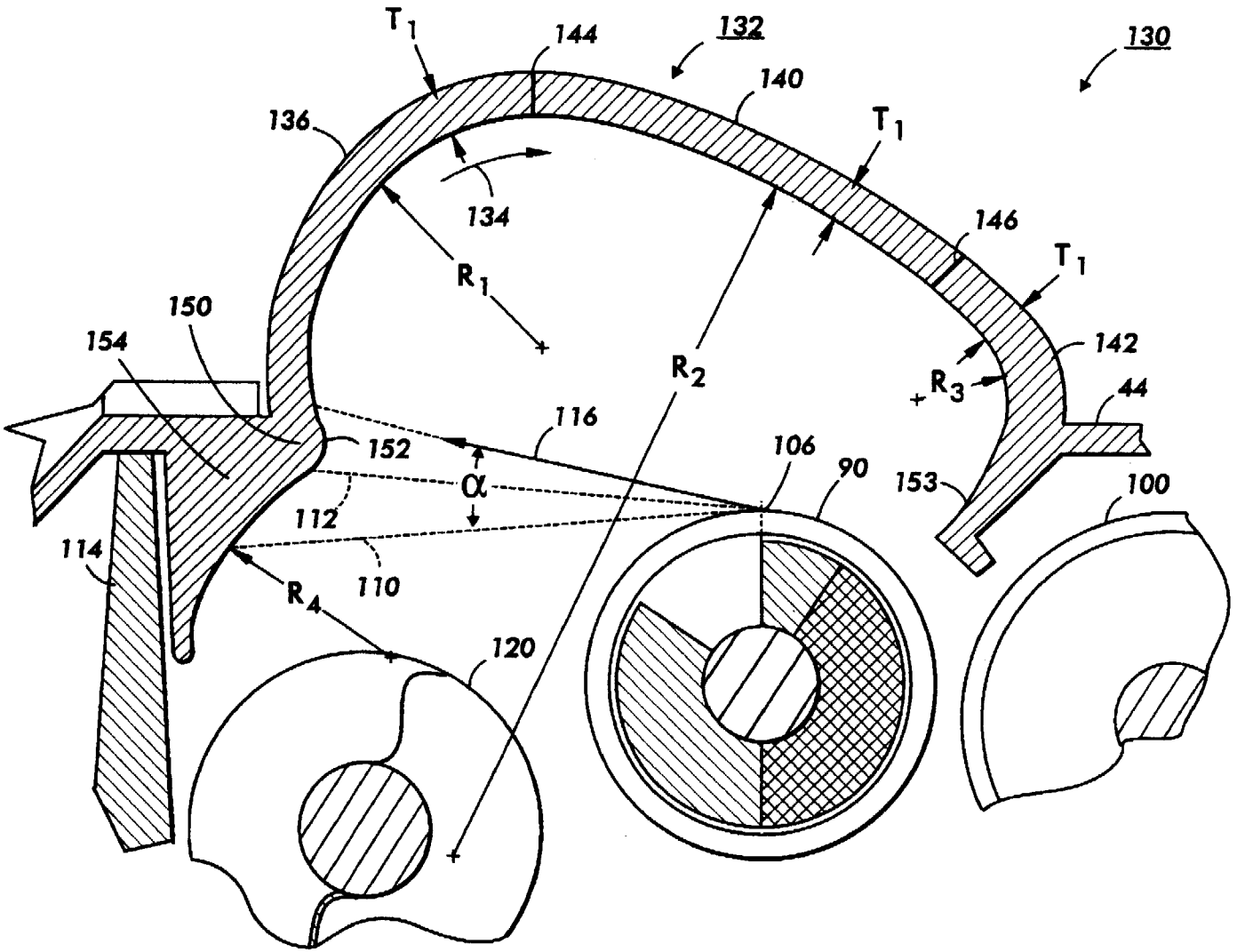
FIG. 1A is a partial sectional view of a portion of the development housing of FIG. 1.
Figure 2:
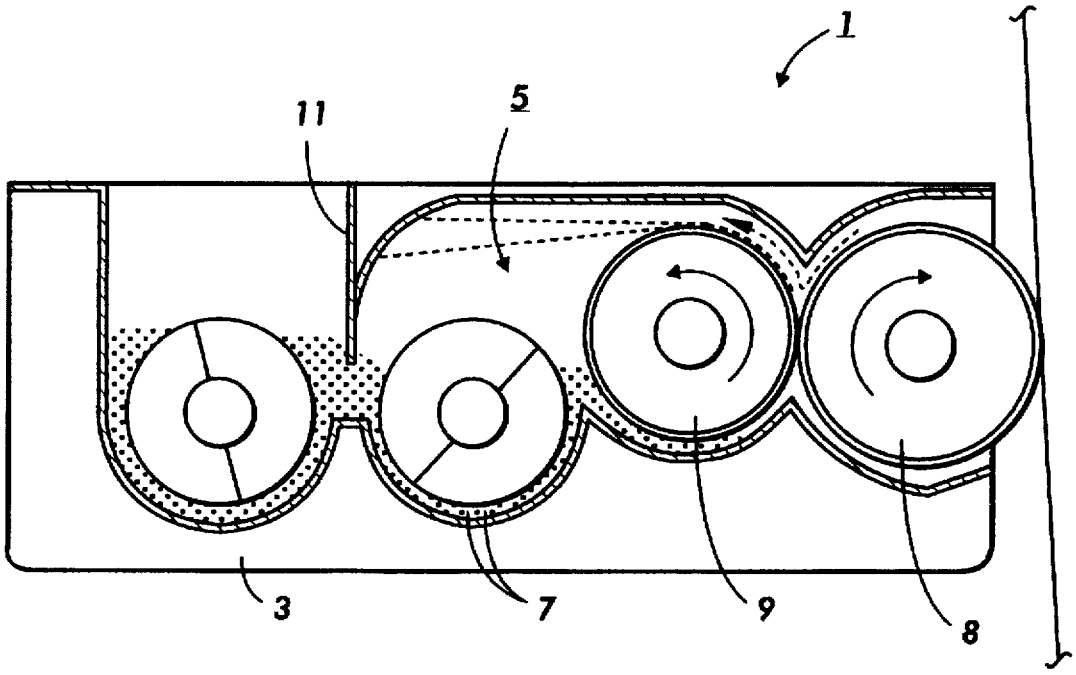
FIG. 2 PRIOR ART
FIG. 2 is a partial sectional view of a prior art development housing.
Figure 3:
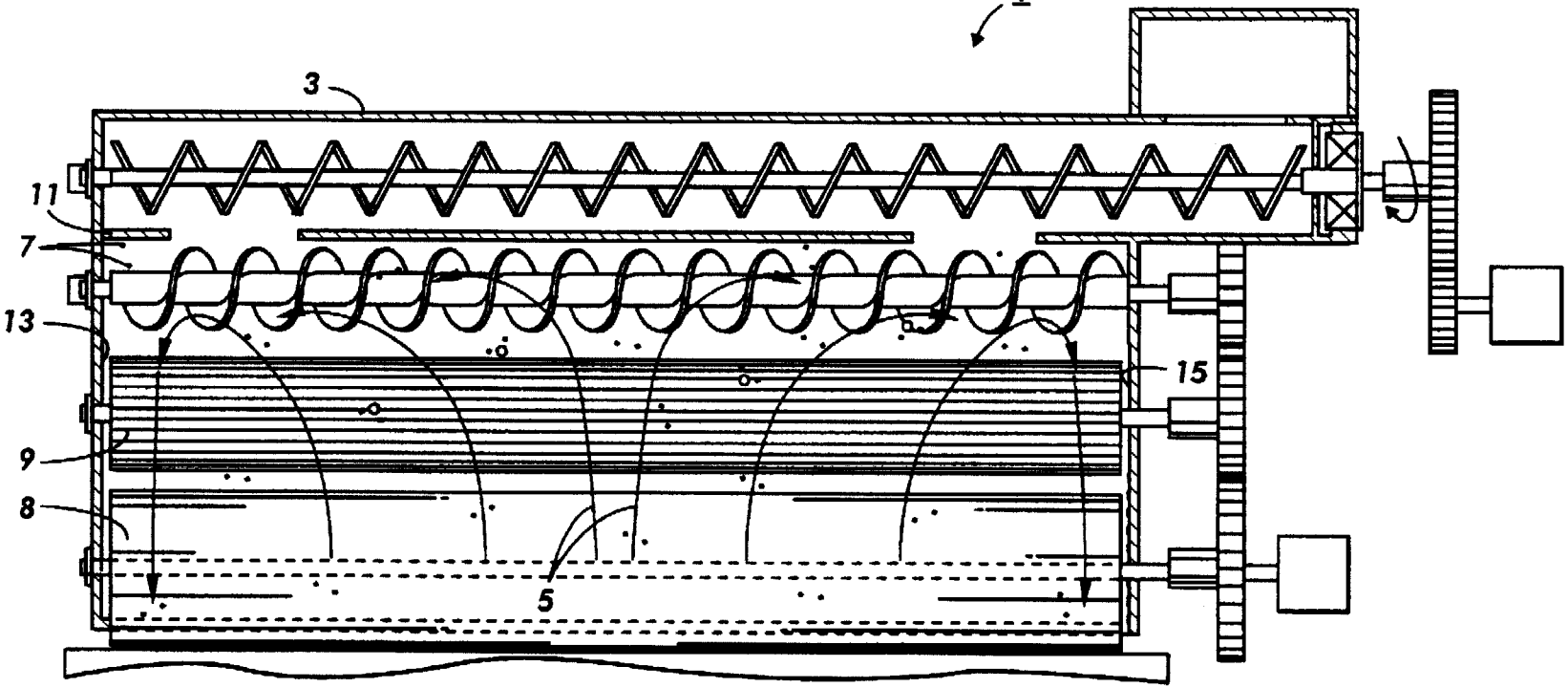
FIG. 3 PRIOR ART
FIG. 3 is a top view of the prior art development housing of FIG. 2.
Figure 4:
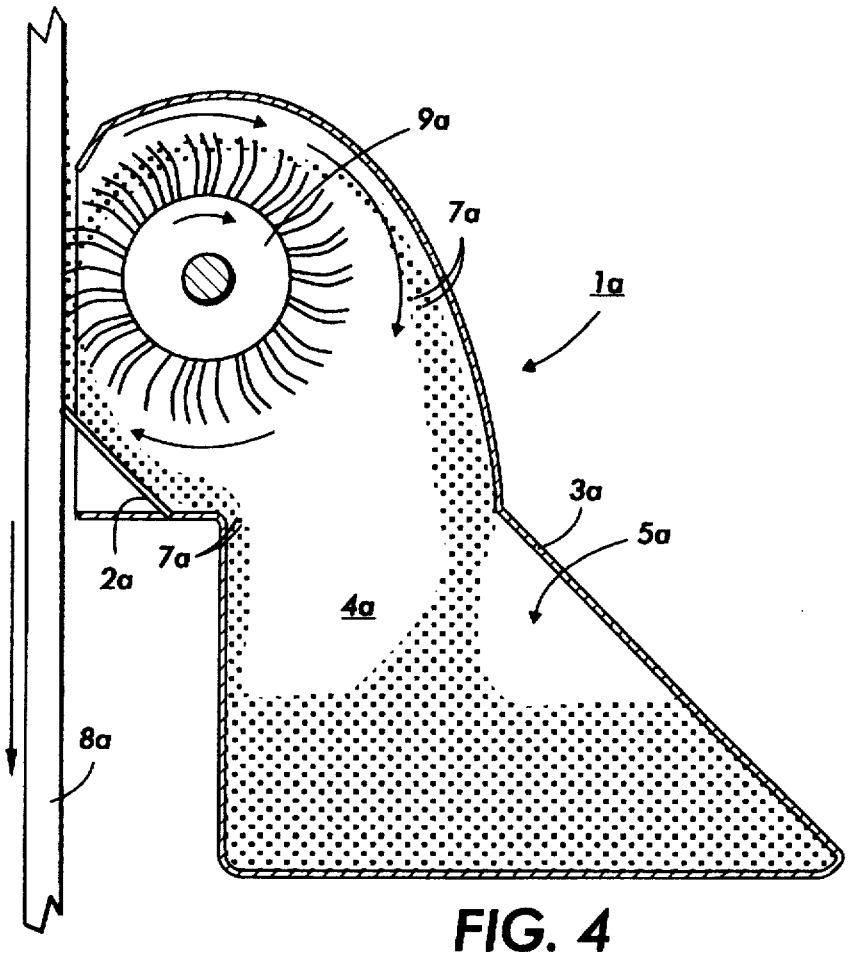
FIG. 4 PRIOR ART
FIG. 4 is a partial sectional view of a prior art cleaning housing.
Figure 5:
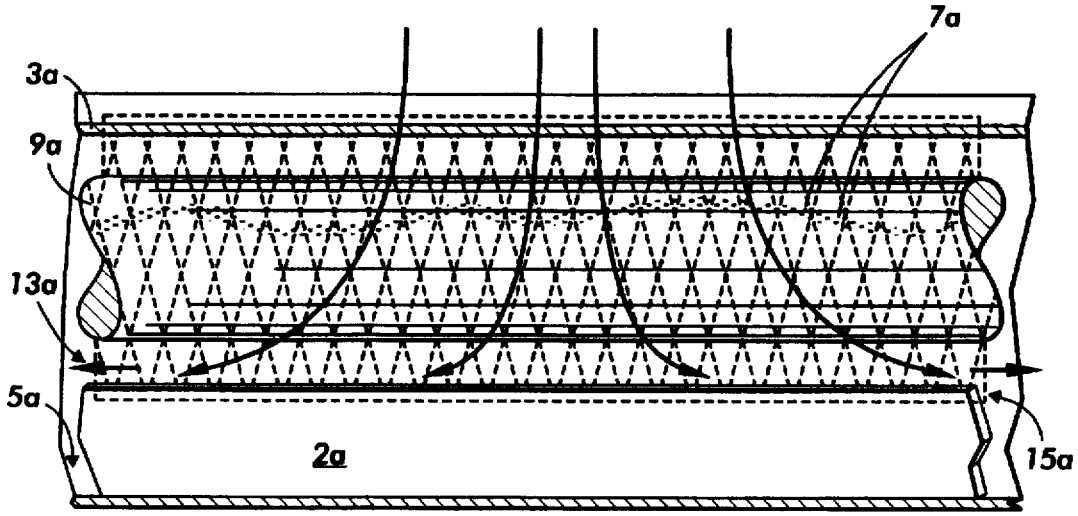
FIG. 5 PRIOR ART
FIG. 5 is a top view of the prior art cleaning housing of FIG. 4.

Referring now to FIG. 1A, the outer stream 116 of air and particles is directed from a position downstream of the magnetic roll 90 to a position upstream of the magnetic roll 90 by a channel 130. The channel 130 may have any shape suitable to properly direct the stream 116. For example the channel may include a wall 132 to direct the stream 116. Preferably the wall is arcuate, for example concave to promote the movement of air in a circular pattern in the direction of arrow 134. The applicants have found that the flow of air in the channel is very dependent on the shape of the wall. The optimum shape may be determined experimentally or may be modeled by sufficient experimental data of roll speeds and developer shapes. The wall 132 may be divided into three areas or members. These areas preferably include a first member 136 or portion of the wall 132 to receive the outer stream 116 of air and the launched stream of material exiting the magnetic roll 90, a second member 140 or portion of the wall 132 to transfer the air received from the first member 136, as well as a third member 142 or portion of the wall 132 to transfer the air received from the second member 140 and to expel the outer stream 116 of air into a position adjacent the magnetic roll 90 upstream of the first position 106 of the magnetic roll 90.

The channel 130 is made from any suitable, durable material, for example, sheet metal or plastic and may be molded integrally with the developer housing 44 or secured to the developer housing in any suitable method such as by welding, fasteners, or by adhesives.

The first member 136, second member 140 and third member 142 have a thickness T1 that is sufficient for the strength of the channel 130 and may be of a thickness similar to that of housing 44.

To promote the smooth flow of air, the first member 136 preferably blends smoothly with the second member 140 at first transition point 144. Similarly the second member 140 preferably blends smoothly with the third member 142 at first transition point 144.

The channel 130 preferably includes a protrusion 150 which extends toward the roll 90 and serves to separate the outer stream 116 from the inner stream 108. The protrusion 150 includes a point of inflection 152 which represent a first end of first member 136.

The outer stream 116 impacts the first member 136 at in included angle $\alpha$. Preferably the angle $\alpha$ is acute to direct the stream of air in the direction of arrow 134. The first member 136 is preferably arcuate, preferably concave. The first member 136 may be described by radius $R_1$. The second member 140 is preferably arcuate, preferably concave. The second member 140 may be described by radius $R_2$. The third member 142 is preferably arcuate, preferably concave. The third member 142 may be described by radius $R_3$. The third member may further include a portion 153 extending generally radially toward the roll 90 to direct the stream to attach the developer material to the roll 90.

The developer housing 44 preferably includes a toner guide portion 154 extending downwardly from the point of inflection 152. The guide portion 154 serves to direct the inner stream 108 toward wall 114. The toner guide portion 154 is preferably arcuate, preferably concave. The toner guide portion 154 may be described by radius $R_4$.

The stream of air 116 contacts wall 132 at first member 136, is directed by first member 136 to second member 140, then directed by second member 140 to third member 142 where it exits the channel 130.

Figure 7:
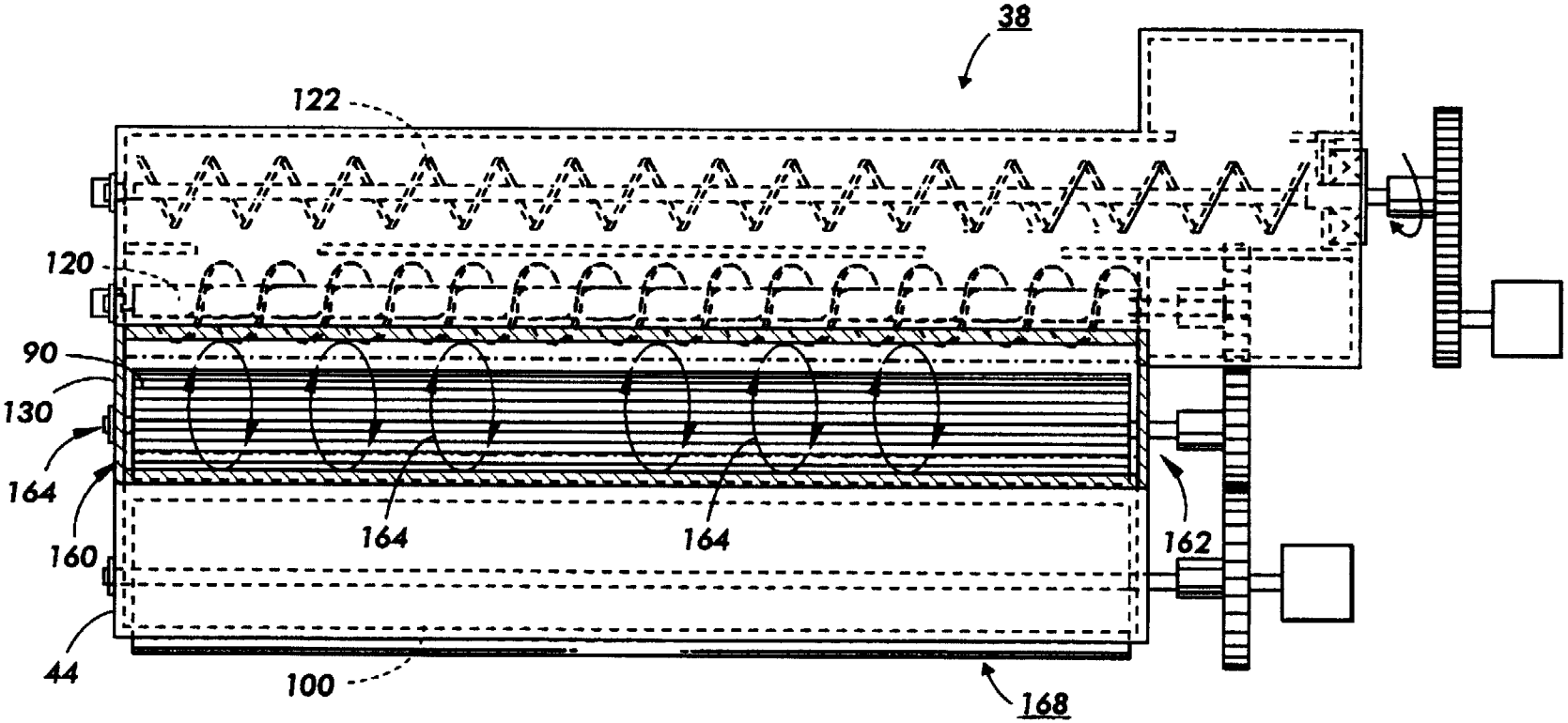
FIG. 7 is a top view of the recirculation conduit of FIG. 1.

Referring now to FIG. 7, the channel 130 preferably extends from first end 160 of the magnetic roll 90 to the second end 162 of the magnetic roll 90. The outer stream 116 of air is directed by channel 130 to form a series of recirculating paths 164 within the channel 130. The recirculating paths 164 greatly reduces fresh air entering the development system 38 at opening 168.

Since little fresh air is introduced into the housing 44, pressure within the developer housing 44 may be stabilized and normalized to a pressure substantially similar to the ambient pressure.

By utilizing air driven by the moving parts within the housing 44, such as the transport roll 90 and by the launched material, and by recirculating the air within the channel 130, the need to drive in any more air into the housing 44 is minimized.

Figure 8:
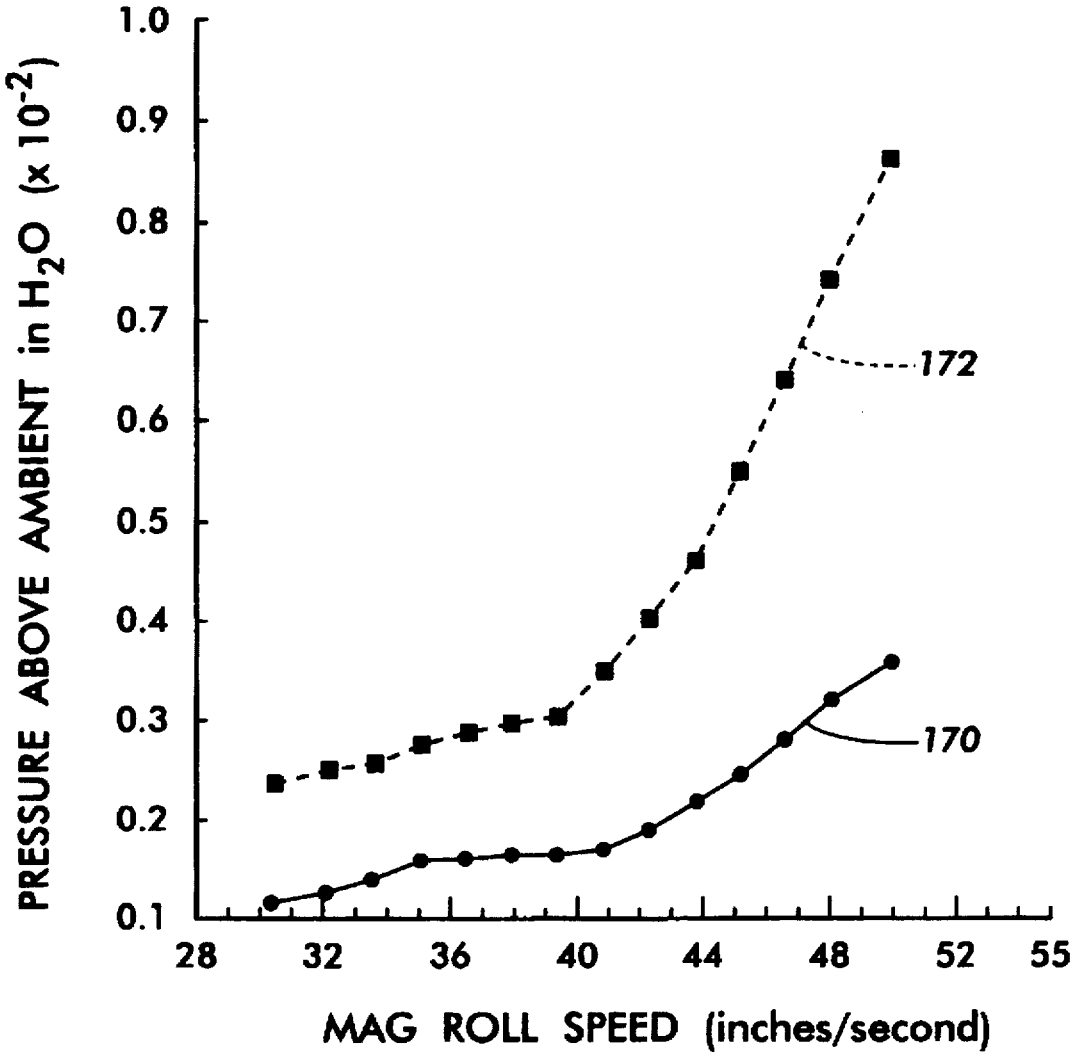
FIG. 8 is a graph of Magnetic Roll speed versus Pressure above Ambient for the prior art housing and the recirculation conduit of the development apparatus of the present invention.

FIG. 8 is a representation of experimental data taken of the pressure inside of the developer housing 44 of a developer unit including the channel of the present invention as well as the corresponding pressure inside a developer housing not having the recirculating channel. These pressures were plotted at a magnetic roll peripheral surface footage of from 30 to 50 inches per second. Line 170 shows the pressure versus magnetic roll speed for a developer housing including the channel of the present invention while line 172 shows the pressure inside the developer housing versus magnetic roll speed for a prior art development housing.

Since the pressure inside the developer housing 44 of a development system including a channel according to the present invention is much lower than a prior art developer housing, the tendency of toner particles 82 leaking from the developer housing 44 is greatly reduced.

The applicants have conducted an experiment with a developer housing including the channel of the present invention and a developer housing not including the channel of the present invention and have plotted the measured total amount of toner expelled from the developer housing at various positions on the periphery of the developer housing. These positions include: a before position outboard of the transport roll (pre roll), an after position inboard of the transport roll (post roll), and three positions along the width of the developer housing. These three positions adjacent the magnetic roll include: outboard, inboard and center. These measurements were taken at 3 percent toner concentration as well as at 5 percent toner concentration. This data is shown in FIG. 9 and FIG. 10.

An alternate embodiment of a developer system including the channel of the present invention is shown in developer system 380 including channel 330 as shown in FIGS. 11 and 11A.

The developer system 380 of FIGS. 11 and 11A is similar to developer system 38 of FIGS. 1 and 1A. The development system 380 includes developer housing 344 which defines a chamber 380 therein. Housing 344 is similar to housing 44 of FIG. 1.

The development system 380 includes magnetic roll 390 which is similar to roll 90 of FIG. 1. The development system 380 further includes donor roll 395 which is similar to roll 100 of FIG. 1.

As with roll 90, roll 390 provides sufficient toner particles 82 to the donor roll 395, where the copy machine produces a high volume of copies, for example, 60 copies per minute or more, the magnetic roll 390 must rotate at high velocity. For example, for a copy machine producing in excess of 60 cpm, a magnetic roll 390 with a diameter of one inch may need to travel in excess of 764 rpm or 40 inches per second at the periphery 398 of the magnetic roll 390. When the magnetic roll 390 rotates in the direction of arrow 305, the excess toner particles 82, which are not transferred to the donor roll 395, are propelled tangentially from a first position 306 on the periphery 398 of the magnetic roll 390. The stream of toner particles 82 exiting tangentially from the first position 306 of the magnetic roll 390 forms an inner stream 308 of marking particles.

The inner stream 308 is bounded internally by an inner boundary 310. The inner stream 308 is further defined by an outer boundary 312 spaced from the inner boundary 310 and extending tangentially from a position slightly spaced from the periphery 398 of the magnetic roll 390. The inner stream 308 extends outwardly between the inner boundaries 310 and outer boundaries 312 and is further bounded by wall 314 between the outer boundary 312 and inner boundary 310. The inner stream 308 of marking particles which impinge upon wall 314 fall by gravity into the sump of the developer housing 344. Positioned slightly external to the outer boundary 312 of the marking particles is a outer stream 316 including air with marking particles 82 entrained within the outer stream 316.

The wall 314 separates first auger 320 from second auger 322. The marking particles 82 from the inner stream 308 of marking particles falls into the sump of the developer housing 344. The particles 82 are drawn by first auger 320 to one end of auger 320 at which a passageway permits the toner particles 82 to pass through wall 314 into the second auger 322. The second auger 322 translates the toner particles 82 in the opposite direction to a second opening at the opposite end of the developer housing. The circulating path of toner particles through the first auger 320 and the second auger 322 promotes mixing of the toner particles 82 with the carrier granules 84 and promotes the charging of the toner particles 82.

The outer stream 316 of air and particles is directed from a position downstream of the magnetic roll 90 to a position upstream of the magnetic roll 90 by a channel 330. The channel 330 may have any suitable shape and preferably includes an inlet 332 to receive the outer stream 316 of air exiting the magnetic roll 90 as well as an outlet 334 to expel the outer stream 316 of air into a position adjacent the magnetic roll 90 upstream of the first position 306 of the magnetic roll 90.

The channel 330 includes an inner boundary member 333 which serves to work with outer wall 335 to permit the channel 330 to form a conduit. Depending on the orientation of the conduit 330, toner may accumulate on the inner boundary member 333 causing the conduit to become restricted. The conduit 330 does however more positively direct the outer stream 316 than channel 130 may direct stream 116.

The conduit 330 is made from any suitable, durable material, for example, sheet metal or plastic and may be molded integrally with the developer housing 344 or secured to the developer housing in any suitable method such as by welding, fasteners, or by adhesives.

Referring now to FIG. 11A, preferably, to promote the flow of the outer stream 316 of air through the conduit 330, the inlet 332 has an inlet centerline 334 which forms an angle $\alpha$ between the inlet centerline 334 and the outer stream 316 of air. The angle $\alpha$ is preferably much less than 90 degrees to promote the flow of the outer stream 316 of air. Likewise, the outlet 334 has an outlet centerline 340 which forms an angle $\beta$ between the outlet centerline 340 and line 337 through roll 390 and position 306. The angle $\beta$ is preferably less than 90 degrees. Angles of $\alpha$ and $\beta$ of approximately 45 degrees have been found to be effective.

To provide angles $\alpha$ and $\beta$ of approximately 45 degrees, preferably, the conduit 330 includes a first member 342, a third member 345 and a second member 346 located therebetween. The first member 342 is defined by an outer radius $R_o$. The first member 342 has a width of Ta. The inlet 332 has a center position $P_i$ which is positioned somewhat near the wall 314, and preferably slightly outside outer boundary 312 of the marking particles.

The second member 346 is connected to the first member 342 and has a generally straight configuration with a thickness $T_s$. The third member 345 is connected to the second member 346 and preferably has a shape symmetrical with the first member 342. The third member 345 is defined by outer radius $R'_o$. The third member 345 has a thickness $T'_a$ similar to the thickness of the first member 342.

The outlet 334 has a centerpoint $P_o$ which is located near transport roll 390. The center position $P_o$ is located adjacent and outside the magnetic roll periphery 398. The center position $P_o$ of the outlet is at a distance $D_1$ from the first position 306 of the transport roll 90. Distance $D_1$ is significantly less than distance $D_2$ between the centerline $P_i$ of the inlet 332 and the first position 306 of the magnetic roll 90.

The stream of air 316 enters the inlet 332, passes through the first member 342, then passes through the second member 346, and finally through the third member 345. The outer stream of air 316 then exits the conduit 330 at the outlet 334 and attaches to the magnetic roll 390 on its periphery.

The conduit 330 preferably extends from the first end of the magnetic roll 390 to the second end of the magnetic roll 390. The outer stream 316 of air is directed by conduit 330 to form a series of recirculating paths within the conduit 330. The recirculating paths greatly reduce the need for fresh air to enter the development system 380.

Since little fresh air is added to the housing 344, pressure within the developer housing 344 may be stabilized and normalized to a pressure substantially similar to the ambient pressure.

In addition to the problems with the emission of toner from a development housing in high volume printing and copying machines, similar problems with toner emissions occur in cleaning housings. Similarly to the recirculating channel for a developer housing according to the present invention, a cleaning housing may include a recirculating channel.

Referring now to FIG. 12 a cleaning unit 400 including a channel 410 according to the present invention is shown. The cleaning unit 400 is used to remove toner and contaminants from photoreceptor 10. The cleaning unit 400 typically includes a cleaning housing 444 which defines a cleaning chamber 438 within the cleaning housing 444. The removed toner is moved axially within the chamber 438. Brush 74 contacts the photoreceptor 10 and loosens up the remaining toner and contaminants from the photoreceptor 10. A cleaning blade 420 then scrapes off the toner. The waste toner and contaminants from photoreceptor 10 are advanced by the blade 420, the brush 74 and gravity to a waste bottle 422 within the chamber 438 of housing 444.

The photoreceptor 10 on which the image is formed must translate at a high speed. To assure that the photoreceptor 10 is properly cleaned, the brush 74 must rotate at sufficient speed to loosen the toner and contaminants from the photoreceptor 10. A portion of the toner and contaminants on the photoreceptor 10 are then launched off the brush 74 into chamber 438 of cleaning unit 410.

A stream 416 of air and particles is created by brush 74 from the photoreceptor 10 to the blade 420. The stream 416 deflects toward channel 410. The stream 416 of marking particles defines an inner boundary 411 thereof extending tangentially from a first position 406 adjacent to the photoreceptor 10 and defines an outer boundary 4 12 spaced from the photoreceptor 10. The channel 410 may have any shape suitable to properly direct the stream 416. For example the channel may include a wall 432 to direct the stream 416. Preferably the wall is arcuate, for example concave to promote the movement of air in a circular pattern in the direction of arrow 434. The applicants have found that the flow of air in the channel is very dependent on the shape of the wall. The optimum shape may be determined experimentally or may be modeled by sufficient experimental data of roll speeds and developer shapes. The wall 432 may be divided into three areas or members, These areas preferably include a first member 436 or portion of the wall 432 to receive the outer stream 416 of air exiting the blade area, a second member 440 or portion of the wall 432 to transfer the air received from the first member 436, as well as a third member 442 or portion of the wall 432 to transfer the air received from the second member 440 and to expel the outer stream 416 of air into a position adjacent the brush 74 upstream of the blade 420.

The channel 410 is made from any suitable, durable material, for example, sheet metal or plastic and may be molded integrally with the developer housing 444 or secured to the developer housing in any suitable method such as by welding, fasteners, or by adhesives.

To promote the smooth flow of air, the first member 436 preferably blends smoothly with the second member 440 at first transition point 445. Similarly the second member 440 preferably blends smoothly with the third member 442 at second transition point 446.

The channel 410 preferably includes a fourth member 450 which extends from a position the first member 436 to a position proximate the third member 442. The fourth member 450 permits the channel 410 to form a conduit. The conduit 41 0 has an inlet 402 and an outlet 404.

The stream of air 416 enters inlet 402, contacts wall 432 at first member 436, is directed by first member 436 to second member 440, then directed by second member 440 to third member 442 where it exits the channel 430 at outlet 404.

The launched toner together with entrained air within the cleaning housing 444 move outwardly to the outer edges (not shown) of the cleaning housing 444. The reduced pressure in the housing 444 reduces the toner and air escaping from the cleaning housing 444.

By utilizing air driven by the moving parts within the housing 444, such as the brush 74, and by recirculating the air within the channel 410, the need to drive in any more air into the housing 444 is minimized.

FIG. 13 shows date collected with and without recirculation chamber within the cleaner, indicating the reduction of the internal pressure and hence dirt emissions.

Since the pressure within the developer housing 44 of a development system including a channel according to the present invention is much lower than a prior art developer housing, the tendency of toner particles 82 leaking from the developer housing 44 is greatly reduced.

Since the pressure within the cleaning housing 444 of a cleaning unit including a channel according to the present invention is much lower than a prior art cleaning unit, the tendency of toner particles 82 leaking from the cleaning unit 444 is greatly reduced.

By providing the channel according to the present invention, pressures within the developer housing and the cleaning housing can be greatly reduced.

By providing a developer housing and cleaning housing with the channel of the present invention, the reduced pressures within the developer housing and cleaning housing resulting from the addition of the channel of the present invention greatly reduce the leakage of toner from the developer housing and cleaning housing. This reduced leakage from the developer housing and cleaning housing improves the cleanliness of the copy machine as well as increasing the reliability of the copy machine from component failure and damage due to leaking toner particles from the developer housing.

By utilizing air driven by the moving parts within the developer housing and the cleaning housing, such as the magnetic roll and the brush, respectively, and by recirculating the air within the developer housing channel and the cleaning housing channel, respectively, the need to drive in any more air into the housings is minimized.

The reduced pressure within the developer housing and cleaning housing including a channel of the present invention reduces the leakage of toner from the developer housing and cleaning housing and in particular greatly improves the leakage of toner for development systems having a greater toner concentration.

The reduced pressure and reduced leakage of the developer housing including the channel of the present invention, permits the use of higher toner concentrations within the developer housing and the developer housings with the higher toner concentration may be more compact and less expensive than larger developer housings that are required for developer systems with a lower toner concentration and less sensitive for reload problems.

The reduced pressure and reduced leakage of the developer housing and cleaning housing including the channel of the present invention reduces the criticality of seals in the developer housing and cleaning housing and may permit the use of less expensive and less effective seals which cause less drag on the developer housing and cleaning housing and generate less heat.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A channel for recirculating a stream of air located adjacent a stream of marking particles exiting substantially tangentially from a marking particle transport member, the stream of marking particles defining an inner boundary thereof extending tangentially from a first position adjacent to said transport member and defining an outer boundary thereof spaced from the transport member and the inner boundary, said channel comprising:

a first member, said first member positioned outside the stream of marking particles, at least a portion of said first member positioned substantially adjacent the outer boundary of the stream of marking particles and spaced from the transport member;

a second member connected to said first member; and a third member connected to said second member, said second member positioned adjacent the transport member and spaced from the stream of marking particles, substantially all the stream of air being directed by said first member being sequentially directed by said second member and said third member, said first member, said second member and said third member being integral with each other.

2. A channel for recirculating a stream of air located adjacent a stream of marking particles exiting substantially tangentially from a marking particle transport member, the stream of marking particles defining an inner boundary thereof extending tangentially from a first position adjacent to said transport member and defining an outer boundary thereof spaced from the transport member and the inner boundary, said channel comprising:

a first member, said first member defining a first surface thereof positioned outside the stream of marking particles, at least a portion of said first surface of said first member positioned substantially adjacent the outer boundary of the stream of marking particles and spaced from the transport member, said first member further defining a second surface thereof, at least a portion of said second surface contacting the stream of marking particles;

a second member connected to said first member; and a third member connected to said second member, said second member positioned adjacent the transport member and spaced from the stream of marking particles, substantially all the stream of air being directed by said first surface of said first member being sequentially directed by said second member and said third member in a first direction and substantially all the stream of marking particles being directed in a second direction different from said first direction.

3. A channel according to claim 2 wherein said third member is positioned upstream of the marking particles.

4. A channel according to claim 2 wherein said first member is elongated in a direction substantially parallel to a longitudinal axis of the transport member.

5. A channel according to claim 2 wherein at least a portion of said first member comprises an arcuate shape.

6. A channel according to claim 2 wherein at least a portion of said third member comprises an arcuate shape.

7. A channel according to claim 2 wherein the transport member comprises a magnetic roll.

8. A channel according to claim 2 wherein the transport member comprises a cleaning brush.

9. A channel according to claim 2 wherein the transport member is positioned between said first member and said third member, proximate said third member and distant said first member.

10. A developer unit for developing with marking particles a latent image recorded on an image receiving member to form a developed image, comprising:

a housing for containing a supply of at least marking particles;

a transport member mounted in said housing for transporting the marking particles toward the image receiving member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member positioned outside the stream of marking particles, at least a portion of said first member positioned substantially adjacent the outer boundary of the stream of marking particles and spaced from the transport member, a second member connected to said first member, and a third member connected to said second member, said second member positioned adjacent the transport member and spaced from the stream of marking particles, substantially all the stream of air being directed by said first member being sequentially directed by said second member and said third member, said first member, said second member and said third member being integral with each other.

11. A developer unit for developing with marking particles a latent image recorded on an image receiving member to form a developed image, comprising:

a housing for containing a supply of at least marking particles;

a transport member mounted in said housing for transporting the marking particles toward the image receiving member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member, said first member defining a first surface thereof positioned outside the stream of marking particles, at least a portion of said first surface of said first member positioned substantially adjacent the outer boundary of the stream of marking particles and spaced from the transport member, said first member further defining a second surface thereof, at least a portion of said second surface contacting the stream of marking particles, a second member connected to said first member, and a third member connected to said second member, said second member positioned adjacent the transport member and spaced from the stream of marking particles, substantially all the stream of air being directed by said first surface of said first member being sequentially directed by said second member and said third member in a first direction and substantially all the stream of marking particles being directed in a second direction different from said first direction.

12. A developer unit according to claim 11 wherein said third member is positioned upstream of the marking particles.

13. A developer unit according to claim 11 wherein said first member is elongated in a direction substantially parallel to a longitudinal axis of the transport member.

14. A developer unit according to claim 11 wherein at least a portion of said first member comprises an arcuate shape.

15. A developer unit according to claim 11 wherein at least a portion of said third member comprises an arcuate shape.

16. A developer unit according to claim 11 further comprising a fourth member located proximate said first member, said second member and said third member so as to form a channel therebetween.

17. A developer unit according to claim 11 wherein the transport member comprises a magnetic roll.

18. A developer unit according to claim 11 wherein the transport member is positioned between said first member and said third member, proximate said third member and distant said first member.

19. A developer unit for developing with marking particles a latent image recorded on an image receiving member to form a developed image, comprising:

a housing for containing a supply of at least marking particles;

a transport member mounted in said housing for transporting the marking particles toward the image receiving member;

a donor member adjacent the transport member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member positioned outside the stream of marking particles, at least a portion of said first member positioned substantially adjacent the outer boundary of the stream of marking particles and spaced from the transport member, a second member connected to said first member, and a third member connected to said second member, said second member positioned adjacent the transport member and spaced from the stream of marking particles, substantially all the stream of air being directed by said first member being sequentially directed by said second member and said third member.

20. An electrophotographic printing machine of the type having a developer unit for developing with marking particles a latent image recorded on an image receiving member to form a developed image, comprising:

a housing for containing a supply of at least marking particles;

a transport member mounted in said housing for transporting the marking particles toward the image receiving member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member positioned outside the stream of marking particles, at least a portion of said first member positioned substantially adjacent the outer boundary of the stream of marking particles and spaced from the transport member, a second member connected to said first member, and a third member connected to said second member, said second member positioned adjacent the transport member and spaced from the stream of marking particles, substantially all the stream of air being directed by said first member being sequentially directed by said second member and said third member wherein said first member, said second member and said third member are integral with each other.

21. An electrophotographic printing machine of the type having a developer unit for developing with marking particles a latent image recorded on an image receiving member to form a developed image, comprising:

a housing for containing a supply of at least marking particles;

a transport member mounted in said housing for transporting the marking particles toward the image receiving member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member, said first member defining a first surface thereof positioned outside the stream of marking particles, at least a portion of said first surface of said first member positioned substantially adjacent the outer boundary of the stream of marking particles and spaced from the transport member, said first member further defining a second surface thereof, at least a portion of said second surface contacting the stream of marking particles, a second member connected to said first member, and a third member connected to said second member, said second member positioned adjacent the transport member and spaced from the stream of marking particles, substantially all the stream of air being directed by said first surface of said first member being sequentially directed by said second member and said third member in a first direction and substantially all the stream of marking particles being directed in a second direction different from said first direction.

22. A printing machine according to claim 21 wherein said third member is positioned upstream of the marking particles.

23. A printing machine according to claim 21 wherein said first member is elongated in a direction substantially parallel to a longitudinal axis of the transport member.

24. A printing machine according to claim 21 wherein at least a portion of said first member comprises an arcuate shape.

25. A printing machine according to claim 21 wherein at least a portion of said third member comprises an arcuate shape.

26. A printing machine according to claim 21, further comprising a fourth member located proximate said first member, said second member and said third member so as to form a channel therebetween.

27. A printing machine according to claim 21 wherein the transport member comprises a magnetic roll.

28. A printing machine according to claim 21 wherein the transport member is positioned between said first member and said third member, proximate said third member and distant said first member.

29. An electrophotographic printing machine of the type having a developer unit for developing with marking particles a latent image recorded on an image receiving member to form a developed image, comprising:

a housing for containing a supply of at least marking particles;

a transport member mounted in said housing for transporting the marking particles toward the image receiving member;

a donor member adjacent the transport member; and a channel for recirculating a stream of air located adjacent a stream of marking particles exiting substantially tangentially from said transport member, the stream of marking particles defining an inner boundary thereof extending tangentially from a first position adjacent to said transport member and defining an outer boundary thereof spaced from the transport member and the inner boundary, said channel including a first member positioned outside the stream of marking particles, at least a portion of said first member positioned substantially adjacent the outer boundary of the stream of marking particles and spaced from the transport member, a second member connected to said first member, and a third member connected to said second member, said second member positioned adjacent the transport member and spaced from the stream of marking particles, substantially all the stream of air being directed by said first member being sequentially directed by said second member and said third member.

30. A cleaning unit for cleaning excess marking particles from an image receiving member, comprising:

a housing for containing a supply of at least excess marking particles;

a cleaning member mounted in said housing for cleaning the marking particles from the image receiving member; and a channel for recirculating a stream of air located adjacent a stream of marking particles exiting substantially tangentially from said image receiving member, the stream of marking particles defining an inner boundary thereof extending tangentially from a first position adjacent to said image receiving member and defining an outer boundary thereof spaced from the image receiving member and the inner boundary, said channel including a first member, said first member defining a first surface thereof positioned outside the stream of marking particles, at least a portion of said first surface of said first member positioned substantially adjacent the outer boundary of the stream of marking particles and spaced from the image receiving member, said first member further defining a second surface thereof, at least a portion of said second surface contacting the stream of marking particles, a second member connected to said first member, and a third member connected to said second member, said second member positioned adjacent the image receiving member and spaced from the stream of marking particles, substantially all the stream of air being directed by said first surface of said first member being sequentially directed by said second member and said third member in a first direction and substantially all the stream of marking particles being directed in a second direction different from said first direction.

* * * * *